US011702724B2

(12) United States Patent
Crook et al.

(10) Patent No.: US 11,702,724 B2
(45) Date of Patent: Jul. 18, 2023

(54) COBALT-CHROMIUM ALLOY RESISTANT TO HIGH SPEED/SELF-COUPLED SLIDING WEAR

(71) Applicant: Haynes International, Inc., Kokomo, IN (US)

(72) Inventors: Paul Crook, Kokomo, IN (US); Ramanathan Krishnamurthy, Carmel, IN (US)

(73) Assignee: Haynes International, Inc., Kokomo, IN (US)

( * ) Notice: Subject to any disclaimer, the term of this patent is extended or adjusted under 35 U.S.C. 154(b) by 24 days.

(21) Appl. No.: 17/211,022

(22) Filed: Mar. 24, 2021

(65) Prior Publication Data

US 2022/0307111 A1 Sep. 29, 2022

(51) Int. Cl.
*C22C 19/07* (2006.01)

(52) U.S. Cl.
CPC ..... *C22C 19/07* (2013.01)

(58) Field of Classification Search
CPC ..... C22C 19/07; C22C 1/0433; C22C 37/06; C22F 1/10; A61L 27/045; A61L 31/022; B23K 35/3046; Y10S 277/94
USPC ..... 420/437
See application file for complete search history.

(56) References Cited

U.S. PATENT DOCUMENTS 5,002,731 A 3/1991 Crook et al.
7,588,650 B2 * 9/2009 Baba ..... C22C 19/07 420/439
9,051,631 B2 6/2015 Wu et al.
9,631,262 B2 4/2017 Wright et al.
10,751,446 B2 * 8/2020 van Bennekom ..... A61C 13/20
2002/0064678 A1 * 5/2002 Kiyotoki ..... C22C 19/057 428/678
2005/0069654 A1 3/2005 Ellis et al.

FOREIGN PATENT DOCUMENTS

CN 102453908 A * 5/2012
CN 107365925 A 11/2017
CN 111575539 A 8/2020
GB 2000188 A 1/1979
WO 9700978 A1 1/1997

OTHER PUBLICATIONS

NPL: on-line translation of CN-102453908-A, May 2012 (Year: 2012).*
Matthews, S.J., et al., Weldability Characteristics of a New Corrosion- and Wear-Resistant Cobalt Alloy, Welding Journal, 1991, No. 12, Miami, FL.

* cited by examiner

*Primary Examiner* — Jie Yang
(74) *Attorney, Agent, or Firm* — Buchanan Ingersoll & Rooney PC

(57) ABSTRACT

A wrought-able, cobalt-based alloy is disclosed which has extraordinary resistant to high speed/self-coupled sliding wear. This alloy contains about 0.83 wt. % nickel, about 0.125 wt. % nitrogen, about 26.85 wt. % chromium, about 4.58 wt. % molybdenum, about 2.33 wt. % tungsten, about 2.97 wt. % iron, about 0.84 wt. % manganese, about 0.27 wt. % silicon, about 0.065 wt. % carbon, and about 0.11 wt. % aluminum, with the balance cobalt plus impurities.

4 Claims, 1 Drawing Sheet

Volume Losses of the Pin under High-Speed/Self-Coupled Sliding Conditions, $mm^3$

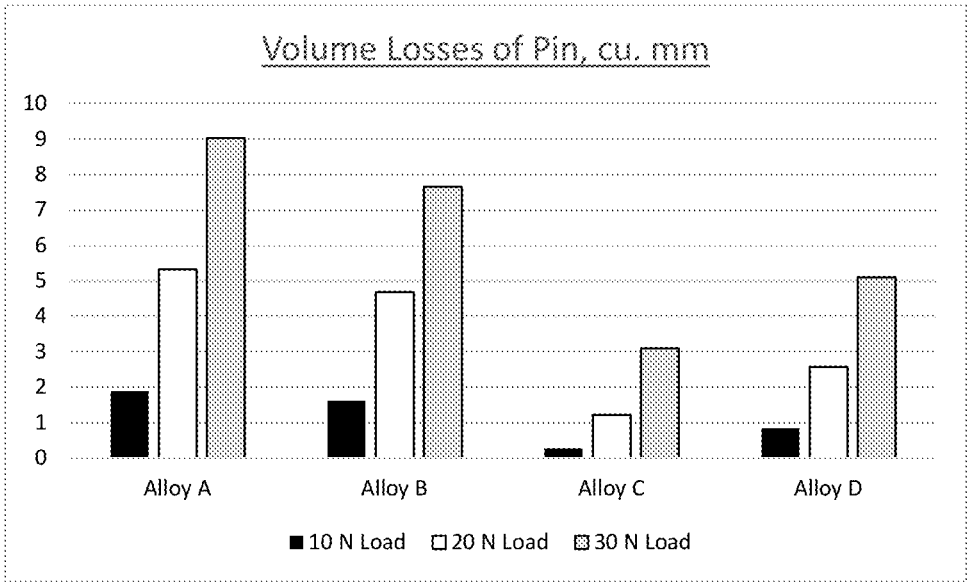
Volume Losses of the Pin under High-Speed/Self-Coupled Sliding Conditions, $mm^3$

COBALT-CHROMIUM ALLOY RESISTANT TO HIGH SPEED/SELF-COUPLED SLIDING WEAR

FIELD OF INVENTION

The invention relates to cobalt-base alloys that are corrosion resistant and wear resistant.

BACKGROUND

One of the main causes of wear of metallic materials is metal-to-metal sliding, particularly in the absence of lubricants. At low speeds and high loads, a phenomenon known as galling can occur, whereby significant amounts of material can be transferred from one surface to the other, and seizure is possible. This is believed to result from atomic bonding of the two surfaces and/or crack propagation deep into one or both surfaces. Highly torqued nuts and bolts are subject to this form of wear, if care is not taken in the choice of materials; austenitic stainless steels are particularly prone to this type of wear when self-coupled (i.e. both surfaces are of the same material).

At the other end of the sliding wear spectrum, high speed, lower load, metal-to-metal sliding systems are prone to different wear mechanisms. These can include (work-hardened) asperity cutting, near-surface fatigue (i.e. cracking due to cyclic stresses), and (if the surface temperatures are sufficiently high, and the environment contains oxygen), the growth and shear of oxides on metallic material surfaces. Unlubricated bearings are prone to this form of wear, i.e. high speed sliding.

The cobalt-chromium alloys are among the most resistant to these forms of wear. Furthermore, they are resistant to highly corrosive liquids, and can withstand many high temperature gaseous environments, much more so than the steels.

One of the key factors in the sliding wear resistance of the cobalt-chromium alloys is their ability to transform structurally from one atomic form to another, namely from metastable face-centered cubic (FCC) to hexagonal close-packed (HCP), under the action of mechanical stress, over an industrially-useful temperature range (dictated by the contents of other elements within the alloy). This occurs by the coalescence of stacking faults (the metastable FCC phase having a low stacking fault energy) and the formation of HCP platelets, within the structure. Not only does this platelet formation absorb energy, but also the platelets restrict plastic deformation, resulting in very high work-hardening rates. Planar slip is exhibited by these materials, enhancing their resistance to fatigue and restricting fracture to the outer surface regions.

Chromium is an HCP stabilizer in cobalt and its alloys. It increases the driving force for, and the temperature range of, the transformation. Likewise, molybdenum and tungsten (which, with chromium, greatly enhance resistance to corrosive liquids) are HCP stabilizers. Nickel, iron, and carbon (within its limited soluble range) are FCC stabilizers in cobalt and its alloys; they reduce the driving force for, and the temperature range of, the transformation.

Pure cobalt exhibits an HCP structure at temperatures below about 420 deg. C. At higher temperatures (up to the melting point) it exhibits an FCC structure. As discussed, elemental additions serve to increase (in the case of chromium, molybdenum, and tungsten, for example) or decrease (in the case of nickel, iron, and carbon, for example) this transformation temperature (TT). The transformation is not easily accomplished by thermal means (it is sluggish). Therefore, upon cooling from their molten state, or after solution annealing at high temperatures, cobalt-chromium alloys tend to exhibit metastable FCC structures at room temperature, up to the TT. On the other hand, the transformation occurs easily under the action of mechanical stress, by the aforementioned process, up to the TT.

The prior art of greatest relevance to this invention is U.S. Pat. No. 5,002,731 (Mar. 26, 1991), the inventors being Paul Crook, Aziz I. Asphahani, and Steven J. Matthews. The commercial embodiment of this patent is known as ULTIMET® alloy. U.S. Pat. No. 5,002,731 discloses a cobalt-based alloy containing significant quantities of chromium, nickel, iron, molybdenum, tungsten, silicon, manganese, carbon, and nitrogen. The patent discloses an unanticipated benefit of carbon (augmented by the presence of nitrogen at a similar level) in the alloy with regard to both cavitation erosion resistance and corrosion resistance. Furthermore, the patent reveals that the influence of nickel on cavitation erosion, at least, was not powerful over the content range 5.3 to 9.8 wt. %. The experimental, wrought materials used in the discoveries of Crook et al. were made by vacuum induction melting, electro-slag re-melting, hot forging and hot rolling (to sheets and plates), and by subsequent solution annealing. Interestingly, a maximum nitrogen content of 0.12 wt. % was claimed due to the fact that a higher level of 0.19 wt. % caused cracking problems during wrought processing.

SUMMARY OF THE INVENTION

We have discovered that a wrought, low-nickel derivative of the commercial embodiment of the alloy disclosed in U.S. Pat. No. 5,002,731 possesses extraordinary resistance to high speed sliding wear, when self-coupled, relative to the original material and to a material with an intermediate nickel content. The influence of nickel is non-linear, and therefore counter to the current theories of cobalt-based alloy metallurgy and tribology (i.e. science of wear). This extraordinary property was achieved at a nickel content of approximately 0.83 wt. % and a nitrogen content of approximately 0.125 wt. %. The alloy was surprisingly amenable to wrought processing (given the teachings of U.S. Pat. No. 5,002,731). Other elements and their approximate contents in this exceptional material are: 26.85 wt. % chromium, 4.58 wt. % molybdenum, 2.33 wt. % tungsten, 2.97 wt. % iron, 0.84 wt. % manganese, 0.27 wt. % silicon, 0.065 wt. % carbon, and 0.11 wt. % aluminum, with cobalt as the balance. During industrial manufacture of this material, it would be subject to the usual compositional variances. Experiments indicate that the extraordinary self-coupled resistance to high speed sliding wear disappears if the nitrogen content is approximately doubled (to 0.254 wt. %). This alloy should possess high resistance to aqueous corrosion, due to its high chromium content and significant molybdenum and tungsten contents.

DESCRIPTION OF THE DRAWING

FIG. 1 is a graph showing the volume loss of the tested alloys under three different high-speed/self-coupled sliding conditions.

DESCRIPTION OF THE PREFERRED EMBODIMENT

The wrought, experimental alloys involved with this discovery were made by vacuum induction melting (VIM), followed by electro-slag re-melting (ESR), to produce ingots of material amenable to hot working. Prior to hot working (i.e. hot forging and hot rolling), ingots were homogenized at 1204° C./2200° F. Based on prior experience with this class of alloys, a hot working start temperature of 1204° C./2200° F. was used for all experimental alloys. Annealing trials indicated that a solution annealing temperature of 1121° C./2050° F. was suitable for this class of materials, followed by rapid cooling/quenching (to create a metastable FCC solid solution structure at room temperature). Hot rolled (then annealed) plates of thickness 12.7 mm were used to create the wear test samples.

To assess the high speed sliding characteristics of each of the experimental materials, they were subjected to the pin-on-disc test described in ASTM Standard G99. This involves the use of a cylindrical pin with a convex or hemispherical cap, which is forced against a flat, circular, rotating disc (with the axis of the cylindrical pin perpendicular to the planar surface of the disc).

For each alloy, three tests were performed (one at a load of 10 N, one at 20 N, and one at 30 N), using a single disc, fixed by bolts to a motor-driven platen, and three different pins (positioned for test at different contact radii on the disc). In all cases, the pins and discs were of the same alloy (i.e. the materials were self-coupled). To enable a constant sliding speed of 1.885 m/s throughout the project, adjustments were made to the rotational speed of the disc, to compensate for the different contact radii. The duration of every test was 1,200 seconds.

The cylindrical pins had a diameter of 6 mm, and therefore a cap radius of 3 mm. The discs had a diameter of 165 mm and a thickness of 8 mm.

alloys. This was not deliberate (i.e. all of the experimental alloys had an aim chromium content of 26 wt. %). It is surmised that the cause of this higher analyzed chromium content in Alloy D was again a higher than anticipated recovery, the chromium and nitrogen being linked in this regard (nitrided-chromium being one of the furnace charge materials).

The purpose of Alloys B and C was to determine the effects of reducing the nickel content of ULTIMET® alloy under high speed sliding wear conditions, Alloy C having a relatively low nickel content, and Alloy B having an intermediate content. The purpose of Alloy D was to establish the effect of increasing the level of nitrogen at the low nickel content.

All other elements within this alloy system were held constant at the levels suggested by U.S. Pat. No. 5,002,731, since these have proved effective in providing corrosion resistance, weld-ability, and manufacturability in industry, over a period of more than 25 years. Chromium, molybdenum, and tungsten (augmented by nitrogen) are believed to be responsible for the high corrosion resistance of the alloys of this system. Iron is believed to benefit manufacturability, particularly as many possible furnace charge materials for cobalt-based alloys contain some iron. Manganese is believed to be beneficial in removing sulfur, during the melting of cobalt-based alloys. Silicon and carbon, at these levels, provide excellent weld-ability, in particular ideal levels of surface tension of molten weld pools. While aluminum was not an element included U.S. Pat. No. 5,002,731, it is essential at low levels (up to say 0.25 wt. %) if the material is to be compositionally refined, during air melting, in an AOD (argon-oxygen decarburization) vessel.

TABLE 1

Compositions of Experimental Alloys, wt. %

| Alloy | Co | Ni | Cr | Mo | W | Fe | Mn | Si | C | N | Al | Comment |
|---|---|---|---|---|---|---|---|---|---|---|---|---|
| A | Balance | 8.90 | 26.63 | 4.85 | 2.29 | 2.93 | 0.78 | 0.23 | 0.067 | 0.127 | 0.09 | Nickel at Level of U.S. Pat. No. 5,002,731 Embodiment |
| B | Balance | 4.77 | 26.89 | 4.64 | 2.24 | 2.93 | 0.85 | 0.29 | 0.062 | 0.104 | 0.12 | Intermediate Nickel Level |
| C | Balance | 0.83 | 26.85 | 4.58 | 2.33 | 2.97 | 0.84 | 0.27 | 0.065 | 0.125 | 0.11 | Alloy of the Invention |
| D | Balance | 1.01 | 28.21 | 6.15 | 2.29 | 2.89 | 0.75 | 0.23 | 0.051 | 0.254 | 0.11 | Approximately Twice the Nitrogen Content |

The compositions of the cobalt-based, experimental alloys pertinent to this discovery are shown in Table 1. Alloy A was made to the aim composition of ULTIMET® alloy (i.e. the embodiment of U.S. Pat. No. 5,002,731). However, chemical analysis of the ingot revealed that this experimental alloy had a nitrogen content exceeding the maximum claimed in U.S. Pat. No. 5,002,731. This was likely due to a higher than anticipated recovery of nitrogen during the melting process. This same "higher than anticipated" recovery was encountered with the other experimental alloys also. Even more surprising was the fact that Alloy D, which had an aim nitrogen content of 0.20 wt. % (but an analyzed content of 0.254 wt. %) was amenable to wrought processing without cracking. This was counter to the teachings U.S. Pat. No. 5,002,731.

It will be noted that the analyzed chromium content of Alloy D was higher than those of the other experimental The compositional variances anticipated during manufacture of Alloy C, the alloy of the present invention, based on prior experience with such materials are as follows:

Nickel: plus or minus 0.375 wt. % (or 0.3754 wt. %, including rounding errors).

Nitrogen: plus or minus 0.02 wt. % (or 0.024 wt. %, including rounding errors).

Chromium: plus or minus 1.5 wt. % (or 1.54 wt. %, including rounding errors).

Molybdenum: plus or minus 0.5 wt. % (or 0.54 wt. %, including rounding errors).

Tungsten: plus or minus 0.5 wt. % (or 0.54 wt. %, including rounding errors).

Iron: plus or minus 1.0 wt. % (or 1.04 wt. %, including rounding errors).

Manganese: plus or minus 0.25 wt. % (or 0.254 wt. %, including rounding errors).

Silicon: plus or minus 0.2 wt. % (or 0.24 wt. %, including rounding errors).

Carbon: plus or minus 0.02 wt. % (or 0.024 wt. %, including rounding errors).

Aluminum: plus or minus 0.075 wt. % (or 0.0754 wt. %, including rounding errors).

These values were taken from the quality system melting specification for ULTIMET® alloy, except in the case of nickel (the content of which is much lower in Alloy C than in ULTIMET® alloy). In the case of nickel, the melting specification associated with a cobalt-based material with a low nickel content (HAYNES® 6B alloy) was used.

If all the compositional variances (including rounding errors) anticipated during industrial manufacturing of Alloy C are at the low end of the range, then Alloy E (an example within the claimed ranges) in the following table would be created. On the other hand, if all the compositional variances (including rounding errors) anticipated during industrial manufacturing of Alloy C are at the high end of the range, then Alloy F (an example within the claimed ranges) in the following table would be created.

Based upon the experimental data generated for Alloys A, B, C, and D, these two examples (i.e. Alloys E and F) are expected to share the extraordinary resistance to high speed/self-coupled sliding wear of the core composition, Alloy C, and should exhibit high resistance to corrosion, by virtue of high chromium contents, and the presence of significant quantities of molybdenum and tungsten.

TABLE 2

Compositions of Other Embodiments, wt. %

| Alloy | Co | Ni | Cr | Mo | W | Fe | Mn | Si | C | N | Al |
|---|---|---|---|---|---|---|---|---|---|---|---|
| E | Balance | 0.4546 | 25.31 | 4.04 | 1.79 | 1.93 | 0.586 | 0.03 | 0.041 | 0.101 | 0.0346 |
| F | Balance | 1.2054 | 28.39 | 5.12 | 2.87 | 4.01 | 1.094 | 0.51 | 0.089 | 0.149 | 0.1854 |

As recommended by ASTM Standard G99 for pin-on-disc tests which induce mostly wear of the pin (rather than the disc), the following equation was used to provide an overall assessment of damage (volume loss) based on laser analysis of the surfaces:

$$\text{Volume Loss, mm}^3 = \frac{\pi\ (\text{Wear Scar Diameter on Tip of Pin, mm})^4}{64\ (\text{Radius of Curvature of Pin Tip, mm})}$$

The values generated for each of the four experimental alloys, at each of the three loads, are presented in Table 3. The values are compared graphically in FIG. 1.

TABLE 3

Volume Losses on Pin, $mm^3$ (Sliding Speed 1.885 m/s and Test Duration 1,200 s)

| Alloy | Test Load 10 N | Test Load 20 N | Test Load 30 N |
|---|---|---|---|
| A | 1.885 | 5.328 | 9.028 |
| B | 1.617 | 4.688 | 7.663 |
| C | 0.269 | 1.220 | 3.094 |
| D | 0.838 | 2.576 | 5.100 |

Review of these data reveal that the claimed material, Alloy C, is approximately 7 times more resistant to high speed sliding wear (self-coupled) than Alloy A at a load of 10 N, about 4.4 times more resistant at a load of 20 N, and approximately 2.9 times more resistant at a load of 30 N. Alloy C also exhibited a significantly lower coefficient of friction during these high speed sliding tests than did Alloy A. For example, the continuous reading of coefficient of friction for Alloy C at a load of 20 N varied between approximately 0.2 and 0.3, whereas the coefficient of friction for Alloy A, at the same load, varied between approximately 0.4 and 0.5. All of these results were totally unexpected, especially as the results for Alloy B (with an intermediate nickel content) were not so far removed from those of Alloy A.

Our alloy can be formed into wrought products such as plates, sheets, bars, tubes, wires, and billet. The alloy may also be used for castings, weldments, weld overlays, and powder products.

Although we have described certain present preferred embodiments of our alloy it should be understood that the invention is not limited thereto but may be variously embodied within the scope of the following claims

We claim:

1. A cobalt-based alloy resistant to high speed/self-coupled sliding wear consisting essentially of 0.83 wt. % nickel, 0.125 wt. % nitrogen, 26.85 wt. % chromium, 4.58 wt. % molybdenum, 2.33 wt. % tungsten, 2.97 wt. % iron, 0.84 wt. % manganese, 0.27 wt. % silicon, 0.065 wt. % carbon, and 0.11 wt. % aluminum, and the balance cobalt plus impurities wherein the alloy has a coefficient of friction between 0.2 and 0.3 at a load of 20N when tested using a pin-on disk method of ASTM Standard G99.

2. The alloy of claim 1 wherein the alloy is in a form selected from the group consisting of plates, sheets, bars, tubes, wires, billets, castings, weldments, weld overlays, and powder products.

3. A cobalt-based alloy resistant to high speed/self-coupled sliding wear consisting essentially of:

0.4546 to 1.2054 wt. % nickel,
0.101 to 0.149 wt. % nitrogen,
25.31 to 28.39 wt. % chromium,
4.04 to 5.12 wt. % molybdenum,
1.79 to 2.87 wt. % tungsten,
1.93 to 4.01 wt. % iron,
0.586 to 1.094 wt. % manganese,
0.03 to 0.51 wt. % silicon,
0.041 to 0.089 wt. % carbon, and
0.0346 to 0.1854 wt. % aluminum, and
the balance cobalt plus impurties;

wherein the alloy has a coefficient of friction between 0.2 and 0.3 at a load of 20N when tested using a pin-on disk method of ASTM Standard G99.

4. The alloy of claim 3 wherein the alloy is in a form selected from the group consisting of plates, sheets, bars, tubes, wires, billets, castings, weldments, weld overlays, and powder products.

* * * * *